United States Patent [19]

Testone

[11] 4,263,636

[45] Apr. 21, 1981

[54] THIN SHEET AIR IONIZER

[75] Inventor: Anthony Q. Testone, Lee, Mass.

[73] Assignee: Statics, Inc., Lee, Mass.

[21] Appl. No.: 46,352

[22] Filed: Jun. 7, 1979

[51] Int. Cl.[3] ..... H05F 3/06

[52] U.S. Cl. ..... 361/230; 313/355; 361/213; 361/220

[58] Field of Search ..... 361/220, 229, 230, 213; 313/355

[56] References Cited

U.S. PATENT DOCUMENTS

| | | | |
|---|---|---|---|
| 3,551,743 | 12/1970 | Koepke | 361/230 |
| 3,652,897 | 3/1972 | Iosue et al. | 361/230 |
| 3,887,809 | 6/1975 | Marx et al. | 361/225 X |
| 3,904,929 | 9/1975 | Kanaya et al. | 361/220 |
| 3,968,405 | 7/1976 | Testone | 361/220 |

*Primary Examiner*—Harry E. Moose, Jr.
*Attorney, Agent, or Firm*—Irvin A. Lavine

[57] ABSTRACT

A miniature flexible air ionizer comprises a first pair of insulating strips having a series of conductive emitters between them, and a second pair of insulating strips having a linear conductor between them and a second linear conductor on that surface of a strip of the second pair which is most remote from the emitter. The emitters and conductors are provided by laminating copper on plastic strips and chemically etching. The emitters are comb-shaped, with teeth having flat ends which are exposed to air and do not extend beyond the strips. An end connector provides mechanical and electrical connections to the ionizer.

31 Claims, 6 Drawing Figures

THIN SHEET AIR IONIZER

The present invention relates to air ionizers for neutralizing static charges.

A number of devices have been disclosed in the prior art for eliminating the problems of static electrical charges. Broadly, these have either been ion generators, typically connected to a source of electric energy, or bleed-off devices, being simple electrically conductive elements connected to ground.

Among the ion generators, there were provided for many years devices such as is generally shown in Iosue et al U.S. Pat. No. 3,652,897, FIG. 1, and referenced in Koepke et al U.S. Pat. No. 3,551,743. These device generally comprised cylindrical assemblies having emitter pins projecting radially from them, and having means for connecting these ion generators to either a source of electrical energy, such as alternating current, or to such a source and to ground.

In the aforementioned Iosue et al patent, there is disclosed a laminated ion generator, made up of four strips of plastic. Between two of the strips, there was provided a series of emitters, made up of generally rectangular plates and each having a tip extending from one side thereof, and outwardly of the pair of plastic strips, the tip being pointed. The emitters were made of conductive material, such as stainless steel, and in the processing, the plates and tips of the emitters were formed from a single strip of material, with bridging portions interconnecting the tips of the plates, the bridging portion being removed after assembly of the emitters between the two plastic strips. Between the other two plastic strips, there was provided a strip of conductive material, such as brass or copper, which extended continuously between the two noted plastic strips. The conductor was to be connected to a source of high voltage, and there was omitted from the disclosure of this patent a necessary ground connection.

The Koepke et al patent discloses an ion generator having an emitter formed of a thin, flat, elongate metallic element, preferably of copper and having a thin coating of gold, this emitter being characterized by spaced points with arcuate surfaces between them. This emitter was adhered to a base of plastic insulating material, in the form of a thin, elongate bar, and on the opposite side of this base, there was provided an elongate, flat, ground member, also adhered to the base. This subassembly was carried within an insulating housing, of generally U-shape, and being apparently extruded.

Testone U.S. Pat. No. 3,968,405 discloses a Static Electricity Suppressor With Patterned Coating, there being provided a base of insulating material in the form of a flat plate or sheet which is coated on two opposite surfaces with conductive coatings of very thin material, which may have been removed, in part, so as to provide a pattern. This disclosure utilizes emitters in the form of pointed wires.

Marks et al U.S. Pat. No. 3,887,809 provides a disclosure of a Corona Discharge Device which is characterized by a tape having at least one conductive layer at its discharge edges, and which tape is movable. It is disclosed that the tape may be a flexible plastic tape provided with an electro-conductive layer, such as vapor-deposited tungsten.

The prior art disclosures hereinabove discussed are more expensive to manufacture than is desirable. Thus, Iosue et al requires the manufacture of an emitter construction with a bridging connector, this being formulated by starting with a plate which is then shaped by stamping or chemical etching, and then there is the required assembly of this structure between two plastic strips, the removal of the bridging portions, and the assembly of the conductor strip between a second pair of plastic strips, and finally the joining of the entire assembly, as in a mold. Further, this construction results in a structure in which emitter tips are exposed, extending beyond the edges of the associated plastic strips. While this patent discusses the control of span-wise stiffness, it would appear that the resulting strip is relatively stiff, and not flexible and pliant.

Koepke et al also requires the production of separate metal strips, and the shaping of one of them, and while no particular shaping method is disclosed, it appears that the shaping of the emitter strip of Koepke et al would be accomplished either by stamping or by etching the strip, following which the emitter strip and the ground strip must be adhered to the base strip. In addition, there must be provided a plastic housing, thereby resulting in substantial cost, and an apparently relatively rigid structure.

The afore mentioned Testone patent discloses a construction utilizing emitters formed of a plurality of pins, which are a relatively expensive form of emitter.

Ion generators which are widely used, and which have pointed wires as the emitters have a life expectency of approximately five years, due to the erosion of the points. For example, a typical wire is 0.062 inches in diameter, and when a point is provided, the point has a diameter of approximately 0.001 inches. This results in an area of 0.0000007 square inches. By the application of electrical energy to the emitter, which discharges at the point, there results the noted erosion, due to the energy which passes from the emitter through the area of the point. In a typical ion generator, the capacitance between the energized conductor and the points is 100 pico pico farads, the foregoing being an approximation, and and not being necessarily standard in all units. It is, however, a typical example.

Another characteristic of the ion generators with wire elements provided with points used as emitters is the limitation on the proximity of the points to any material which is to be subjected to ionization. Typically, the emitter wires are spaced apart $\frac{3}{4}$ of an inch, and have an effective included cone angle of 60 degrees. Consequently, the effective cone of one emitter will merge with its adjacent neighbor $\frac{3}{4}$ of an inch from the emitter point, with the result that, for effective operation, the emitter point had to be at least $\frac{3}{4}$ inch from the material to be ionized. In certain installations, this required spacing is undesirable because it interferes with the making of a particular machine as compact as desired.

There have been a number of suggestions, as noted above, of grounded conductive elements, in former days this taking the form merely of a conductive sheet with plural teeth, and a conductor connected to ground. Kanaya et al U.S. Pat. No. 3,904,929 provides a construction in which a carbon black-high molecular resin composition is applied to a base material which may be woven, unwoven or knit textile, or paper, the conductive material having a saw tooth outline with the teeth extending outwardly of the edge of the textile or paper base or backing. A ground is provided. This construction, while relatively flexible, is not effective in a large number of situations where ion generation is the only solution to the required neutralization of static charges.

SUMMARY OF THE INVENTION

The present invention is directed to an air ionizer which is constructed of insulating sheets, preferably in the form of strips, some of which are provided with a coating of conducting material in a desired pattern. More particularly, there may be provided four strips of insulating material, such as a resin, a first strip having on one side a conductive coating pattern providing a series of spaced thin, planar, flat teeth-like elements which extend transversely to the length of the strip. Each element is generally rectangular in transverse cross-section, and therefore has ends which are rectangular, and provide a substantial emitter area. These ends do not extend beyond the boundaries of the strip, although they are exposed to atmosphere. A second strip is provided which is without a coating, and may be laminated to the first strip, so as to sandwich the emitter coating pattern between the two strips. A third, plain strip is provided, and a fourth strip is provided having on each side a linearly extending conductive pattern or member. The third strip is laminated to the fourth strip so as to sandwich between them one of the conducting patterns, and then the two thus laminated strips are placed adjacent each other, with that linear conducting pattern which is exposed being remote from the emitter pattern captured between the first and second strips.

The strips are mounted by means of end connectors, made up of a pair of molded elements joined together, with the end portions of the strips between the two elements of the end connectors.

A method is provided for making an air ionizer in which two sheets of insulating material, preferably linearly extending strips are provided with pattern coatings, a first sheet or strip being provided with a thin, planar, flat coating in the form of teeth-like elements which will serve as emitters, and a second sheet or strip being provided with linearly extending conductive coatings on either side thereof. The pattern coatings are preferably formed by known depositing and etching techniques used in connection with printed circuit boards. The two sheets or strips are joined into a completed ionizer, having one or more insulating sheets or strips between them. Preferably, two additional insulating sheets or strips are used, one laminated to the first sheet or strip having the emitters, so as to sandwich the emitters between two sheets or strips, and an additional insulating sheet or strip is provided so as to sandwich a linearly extending conductor between two sheets or strips.

Among the objects of the present invention are to provide an air ionizer of extremely small dimensions, with capacity suitable for use in normal industrial applications. Another object is to provide an ion generator of economical construction, made of available materials and techniques, and still further objects are to provide an air ionizer which will have long life and which may be placed in close proximity to material to be ionized.

Other objects and many of the attendant advantages of the present invention will be readily understood from the following specification, claims and drawings.

DESCRIPTION OF THE PREFERRED EMBODIMENT

Figure 1:
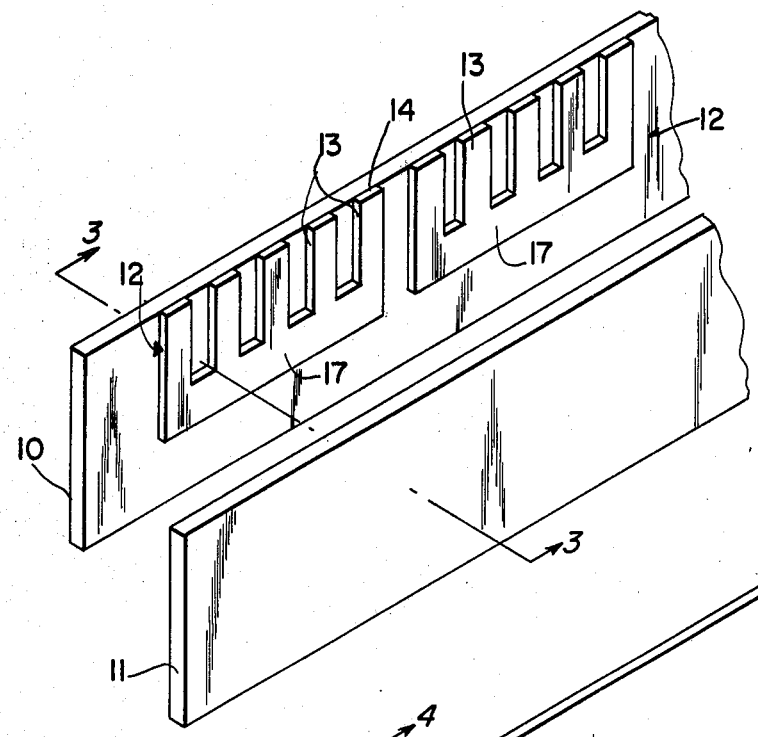
FIG. 1 is an exploded perspective view of a first pair of insulating strips forming a part of the present invention.
Figure 3:
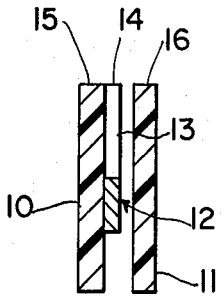
FIG. 3 is a cross sectional view taken on the line 3—3 of FIG. 1.
Figure 5:
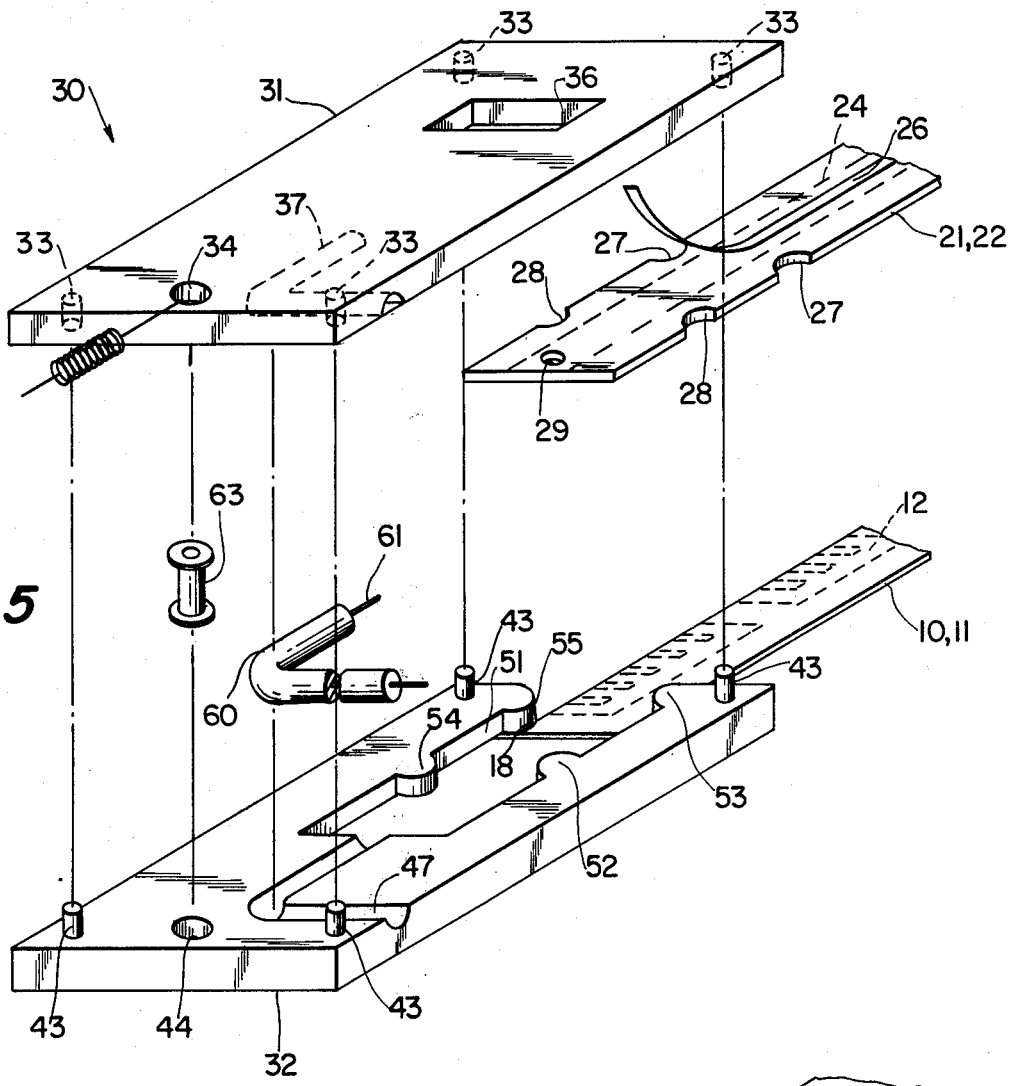
FIG. 5 is an exploded perspective view of the strips of FIGS. 1 and 2, after lamination, and of elements of an end connector.

Referring now to the drawings, wherein like or corresponding reference numerals are used for like or corresponding parts throughout the several views, there is shown in FIG. 1 a first planar, linearly extending strip 10 of insulating material, adjacent to which is a second such strip 11. Each of these strips is preferably made of Mylar of ten mil thickness and having a width of approximately ⅜ inch. On one side of the strip 10 there is a series of emitters 12, each comprising a plurality of spaced, teeth-like elements 13 which extend transversely of the length of the strip 10 and have their terminals 14 exposed to atmosphere. These terminals, as may be seen from FIG. 3, are coplanar with the upper edge 15 of the strip 10, and the upper edge 16 of the strip 11 also lies in this same plane. Thus, the terminals 14 are defined by substantially flat surfaces, which will enable the ion generator to have a long operating life. For example, in a preferred embodiment, the thickness of the emitter pattern 12 is approximately 0.0014 inches, and the width of each of the elements 13 is 0.031 inches. The resulting area of the terminal 14 is 0.0000434 square inches. Typically, an emitter 12 will have twelve teeth; each of the emitters 12 shown in FIG. 5 is shown with five teeth, for convenience of illustration. Therefore, when provided with twelve teeth 13, each emitter 12 will have 0.0052 square inches. The teeth 13 of each emitter 12 are integral with a linearly extending connector portion 17.

The emitters 12 are provided on the strip 10 by known techniques, such as by the deposition of copper onto a Mylar substrate, and then the etching of portions of the deposited copper so as to provide the desired pattern.

The insulating strip 11 is plain, that is, it does not have a pattern coating applied to it. The strip 11 is laminated to the strip 10, so as to sandwich the series of emitters 12 between the strips 10 and 11. The width of the thus-laminated strip, resulting from the lamination of the strips 10 and 11, is only slightly over 20 mils, since the width of the emitter 12 is only that of a deposited copper coating, for example 0.031 inches.

Figure 2:
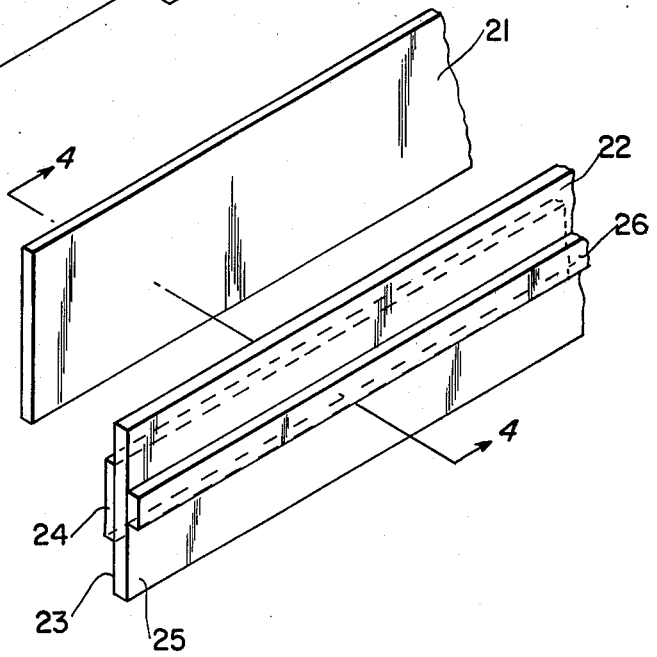
FIG. 2 is an exploded perspective view of a second pair of insulating strips forming a part of the present invention.
Figure 4:
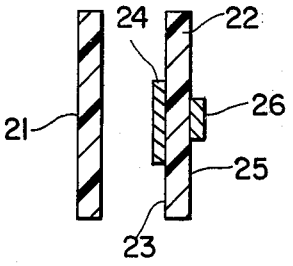
FIG. 4 is a cross sectional view taken on the line 4—4 of FIG. 2.

Referring now to FIG. 2, there is shown a third strip 21 which is, like the strip 11, plain and not provided with a pattern. A fourth strip 22 is provided having on a first side 23 thereof a linear conductor 24 and on the other side 25 thereof a linear conductor 28. The conductors 24 and 26 are formed in the same manner as the emitters 12. As can be seen in FIG. 4, the emitter 24 is spaced from the upper and lower edges of the insulating strips 21 and 22, and the conductor 26 is similarly located, being in opposed relationship to the conductor 24. In practice, of course, just as the strips 10 and 11 are laminated to each other to form a unified, flexible strip 21 and 22 are laminated to each other, sandwiching, thereby, the conductor 24 between them. Thereafter, the two resulting strips are placed adjacent to each other with the conductor 26 remote from the emitter 12. That is, the ion generator is provided by moving the structures as shown in FIGS. 3 and 4 together so that the right hand surface of the strip 11 is adjacent the left hand surface of the strip 21, as viewed in FIGS. 3 and 4. The resulting ion generator will therefore be seen to have a height, in a preferred form, of ⅜ inch, and a thickness of slightly over 40 mils. Due to the above noted surface area of each emitter 12, the ion generator formed by the structures shown in FIGS. 1 and 2 may be placed in much closer proximity to material to be subjected to ionization than the usual ¾ inch obtainable with emitters of wire.

It is further noted that for each emitter, there are, in the preferred embodiment, twelve of the emitter teeth 13.

Referring now to FIG. 5, there is shown an exploded view of an end connector generally designated 30, and comprising a pair of blocks 31 and 32 of insulating material, intended to be positioned in facing relationship. Block 31 is provided with four holes 38, adjacent the corners thereof and a hole 34 extending therethrough adjacent one end. There is also provided an opening 36, shown as being of generally square shape, and, on the underside of the block 31 there is a generally L-shaped groove 37.

The block 42 has a corresponding L-shaped groove 47, and at the four corners thereof it has locating pins 43, which are sized and positioned to enter into the openings 33. There is also provided an opening 44 which is in line the opening 34. At the end opposite 34. At the end opposite the opening 44, block 32 is provided with a recess generally designated 51 and having on one side thereof protuberances 52 and 53 and on the other side thereof protuberances 54 and 55. The pairs of protuberances are opposite each other, and as will be seen, the L-shaped groove 47 is in communication with the recess 51.

The laminated strip which is constructed as shown in FIGS. 1 and 2, and includes the insulated strips 10, 11 and the emitter 12 is provided adjacent one end with a pair of notches, notch 18 being shown in FIG. 5, and engaging the protuberance 55. A similar notch will be understood to be positioned opposite notch 18, and to be engaged by the protuberance 53. It will be observed that the laminated emitter strip 10, 11, 12 does not extend into the recess 51 substantially beyond the protuberances 53 and 55.

Also shown in FIG. 5 is the laminated strip constructed as shown in FIGS. 2 and 4, and including insulated strips 21 and 22, as well as the conductors 24 and 26. There are also provided on this laminated structure a first pair of notches 27 and a second pair of notches 28, to engage the protuberances 53, 55 and 52, 54, respectively. It will be seen, therefore, that the end of the laminated strip 21, 22 extends further into the recess 51 than does the end of the laminated strip 10, 11. Also, it will be observed that an end of the conductor 24 extends upwardly out of the plane of the laminated strip 21, 22, or, alternatively, a separate connector element may be provided, joined to the conductor 24, to extend upwardly as illustrated. A hole 29 extends through the insulated strip 21, 22 and through the linear conductor 24.

An insulated wire 60 having a conductor 61 therewithin is formed in L-shaped, so as to fit into the L-shaped grooves 37 and 47, with the bare wire 61 extending therefrom and into recess 51, where it passes through the hole 29, so as to make contact with linear conductor 24. The other end of the conductor 61 may be seen, in FIG. 6, to extend from the assembled end connector blocks 31 and 32. It is thereby accessible for contact with a source of electrical energy, in the normal fashion.

An eyelet 63 is provided which is used to hold the blocks 31 and 32 in assembled relationship, with the insulated wire 60 within them, and also with the ends of the emitter strip 10, 11 on the one hand and ground-and-bus strip 21, 22 on the other hand in the recess 51. The upstanding end of the conductor 26 is passed through the opening 36.

Figure 6:
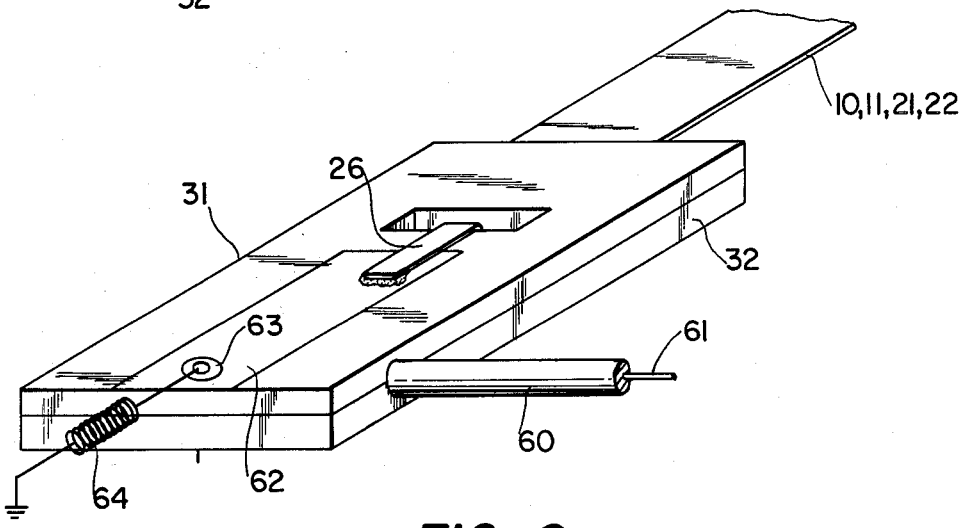
FIG. 6 is a perspective view of the end connector and strips attached.

Referring now to FIG. 6, the assembled end connector is shown, with the ion generator formed by the juxtaposition of the emitter strip 10, 11 and the gound-and-bus strip 21, 22. The end of the conductor 26 is soldered to a conductive pattern 62 on the exterior surface of the connector block 31, which is connected to ground through eyelet 63 and spring 64. The opposite end of the air ionizer is supported by an end connector (not shown) which is made of similar blocks to blocks 31 and 32. There is omitted the wire 60 therefrom, and voids in the assembled opposite end connector and ionizer are filled with a suitable material, such as an epoxy.

The air ionizer thus formed will be seen to be of the capacitive coupled type, the emitters 12 and the conductor 24 providing the capacitor, separated by strips 11 and 21. Connection to ground is provided through the conductor 26.

While production of the laminated strip as shown in FIG. 1 and 3 on the one hand and 2 and 4 on the other hand is effected in the manner hereinabove described, other fabrication techniques than deposition and etching may be utilized. Also, while there are a total of four insulated strips shown, it will be recognized that, depending upon the specific manufacturing steps utilized, a greater or lesser number of strips may be used. For example, in some manufacturing techniques, it may be possible to utilize only three strips, in effect combining strips 11 and 21 into a single strip. Also, while it has been disclosed that the conductors 24 and 26 are both provided on the strip 22, it is possible that conductor 24 could be provided on the strip 21. The specific techniques for forming the laminated strips 10, 11 and 21, 22 may be varied. For example, the emitter strip 10, 11 may be obtained by forming a laminated strip with the emitter patterns therein and then slicing longitudinally so as to provide the edges 15 and 16 and terminal 14. As above indicated while the preferred embodiment of the invention is to form an ionizer which is flexible and of strip shape, it may also be made rigid, and/or of a shape other than a strip, such as of the size and shape of a work table, with the emitter terminals at one or more edges.

The herein provided air ionizer is of extremely economical construction in comparison with those previously known. By virtue of the small size of the preferred embodiment, it may be utilized in very small spaces, and usually will require no revision or redesign of machinery in order to accommodate it. Being flexible in the preferred embodiment, it is not subject to damage if struck by a moving part of machinery in which it is placed, or by a moving web of material being ionized. Also, since it is mounted on a resilient suspension support, shocks may be readily accommodated. The ion generator may be placed very close to the material being ionized, without loss of effectiveness, and will have a very long life, due to a construction which avoids erosion and therefore deterioration of the emitter elements.

The herein disclosed method is one which permits the very economical production of ion generators, utilizing known techniques and available materials of low cost.

It will be obvious to those skilled in the art that various changes may be made without departing from the spirit of the invention, and therefore the invention is not limited to what is shown in the drawings and described in the specification but only as indicated in the appended claims.

I claim:

1. A flexible, miniature air ionizer comprising:

a first planar, linearly extending strip of insulating material, planar conductive emitter means engaging one side of said first strip and comprising spaced teeth-like elements extending transversely of the length of said strip and having exposed terminals at or within the edges of said strip, planar, linearly extending strip means of insulating material adjacent to said first strip with said emitter means between them, a further planar linearly extending strip of insulating material, adjacent said strip means, a linear conductor between said strip means and said further insulating strip in capacitive relation to said emitter means, and linearly extending conductor means on the side of said further insulating strip remote from said linear conductor.

2. The air ionizer of claim 1, wherein said air ionizer consists of components which individually flexible.

3. The air ionizer of claim 1, wherein said emitter means, conductor and conductor means are each a thin layer of conductive material.

4. The air ionizer of claim 1, said emitter means comprising a linear series of emitters, each said emitter comprising a plurality of said transversely extending teeth-like elements and a linearly extending connector portion integral with each of said teeth-like elements.

5. The air ionizer of claim 4, wherein said terminals of said elements lie in substantially the same plane.

6. The air ionizer of claim 5, said terminals each being defined by a substantially flat surface.

7. The air ionizer of claim 1, said terminals each being defined by a substantially flat surface.

8. The air ionizer of claim 1, said strips and strip means being of approximately the same width, the respective edges thereof being substantially coplanar.

9. The air ionizer of claim 1, said strips and strip means being of synthetic resin material.

10. The air ionizer of claim 1, said strip means comprising a pair of strips.

11. The air ionizer of claim 1, and connector means at an end of said ionizer for supporting said end means for connecting said conductor to a source of current, and means for connecting said conductor means to ground.

12. The air ionizer of claim 11, said connector means comprising a pair of blocks of insulating material in facing relationship, said strips and strip means extending into at least one said block.

13. The air ionizer of claim 12, at least one said block having a recess therein for receiving said strips and strip means, and means for securing said strips means to said blocks.

14. The air ionizer of claim 12, said last mentioned means comprising notches in said strips and strip means and mating protuberances on said block.

15. The air ionizer of claim 1, said strip means comprising a pair of strips, one strip of said pair joined to said first strip and the other to said further strip.

16. The air ionizer of claim 15 and connector means at an end of said ionizer comprising a pair of blocks of insulating material in facing relationship, one said block having a recess therein, said strips extending into said recess, and means for securing said strips to said one block.

17. The combination of claim 16, said last mentioned means comprising notches in said strips and mating protuberances on said block.

18. The combination of claim 17, said other strip of said pair and said further strip extending a greater distance into said recess than said first strip of said pair and said first mentioned strip, means in said connector means for connecting said linear conductor to a source of energy, and means for connecting said conductor means to ground.

19. The combination of claim 17, said last mentioned means comprising an opening in the other said block, and a portion of said conductor means extending therethrough.

20. An air ionizer comprising:

a first sheet of insulating material, flat conductive emitter means engaging one side of said first sheet and comprising spaced, parallel teeth-like elements and having exposed terminals at or within an edge of said strip, sheet means of insulating material adjacent to said first sheet with said emitter means between them, a further sheet of insulating material, adjacent said sheet means, a linear conductor between said sheet means and said further insulating sheet in capacitive relation to said emitter means adapted to be connected to a source of electric energy, and linearly extending conductor means on the side of said further insulating sheet remote from said linear conductor and adapted to be connected to ground.

21. The ionizer of claim 20, wherein said emitter means, conductor and conductor means are each a thin layer of conductive material.

22. The air ionizer of claim 20, said emitter means comprising a series of emitters, each said emitter comprising a plurality of said transversely extending teeth-like elements and a linearly extending connector portion integral with each of said teeth-like elements.

23. The air ionizer of claim 22, wherein said terminals of said teeth-like elements lie in substantially the same plane.

24. The air ionizer of claim 23, said terminals each being defined by a substantially flat surface.

25. The air ionizer of claim 20, said terminals each being defined by a substantially flat surface.

26. The air ionizer of claim 20, said sheet means comprising a pair of sheets.

27. The air ionizer of claim 20, and connector means for connecting said conductor to a source of current, and means for connecting said conductor means to ground.

28. The air ionizer of claim 20, said sheet means comprising a pair of sheets, one sheet of said pair joined to said first sheet and the other to said further sheet.

29. A method of making an air ionizer comprising:

providing a first sheet of insulating material having a pattern of conductive material on one side thereof, said pattern comprising teeth-like elements transversely of said strip to an edge thereof.

providing a second sheet of insulating material and positioning one side of said second sheet adjacent of said one side of said first sheet.

providing a third sheet of insulating material, and positioning a first side thereof adjacent the other side of said second sheet.

providing a first linearly extending pattern of conductive material between said second and third sheets, and providing a second linearly extending pattern of conductive material on the other side of said third sheet of insulating material.

30. The method of claim 29, and further comprising providing said first linearly extending pattern of conductive material on said first side of said third sheet.

31. The method of claim 29, and further comprising providing said second sheet from a pair of sheets, attaching a first sheet of said pair to said one side of said first sheet with said pattern of conductive material between them, and attaching the second sheet of said pair to said third sheet with the first linearly extending pattern of conductive material between them.

* * * * *